US006883493B2

(12) United States Patent
Matischok et al.

(10) Patent No.: US 6,883,493 B2
(45) Date of Patent: Apr. 26, 2005

(54) METHOD AND DEVICE FOR OPERATING THE DRIVE MOTOR OF A VEHICLE

(75) Inventors: Lilian Matischok, Stuttgart (DE); Juergen Biester, Boeblingen (DE); Holger Jessen, Dortmund (DE); Thomas Schuster, Brackenheim (DE); Rainer Mayer, Weil der Stadt (DE)

(73) Assignee: Robert Bosch GmbH, Stuttgart (DE)

( * ) Notice: Subject to any disclaimer, the term of this patent is extended or adjusted under 35 U.S.C. 154(b) by 145 days.

(21) Appl. No.: 10/380,874

(22) PCT Filed: Jul. 4, 2002

(86) PCT No.: PCT/DE02/02441

§ 371 (c)(1),
(2), (4) Date: Mar. 19, 2003

(87) PCT Pub. No.: WO03/008790

PCT Pub. Date: Jan. 30, 2003

(65) Prior Publication Data

US 2004/0011575 A1 Jan. 22, 2004

(30) Foreign Application Priority Data

Jul. 19, 2001 (DE) ..... 101 35 077

(51) Int. Cl.[7] ..... F02D 13/04

(52) U.S. Cl. ..... 123/325; 123/319; 123/395; 123/493

(58) Field of Search ..... 123/319, 320, 123/325, 326, 395, 493, 436

(56) References Cited

U.S. PATENT DOCUMENTS

| | | | |
|---|---|---|---|
| 5,558,178 | A | 9/1996 | Hess et al. |
| 5,782,221 | A | 7/1998 | Woldt |

FOREIGN PATENT DOCUMENTS

| | | |
|---|---|---|
| DE | 44 45 462 | 6/1996 |
| DE | 199 00 740 | 7/2000 |
| EP | 0 449 160 | 10/1991 |

*Primary Examiner*—Bibhu Mohanty
(74) *Attorney, Agent, or Firm*—Walter Ottesen

(57) ABSTRACT

A method and an arrangement for operating a drive unit of a vehicle are suggested. Starting from a driver command torque which is converted into a resulting desired torque while considering additional torques, a correction of the resulting desired torque is undertaken in dependence upon the loss torques, which are not available for the drive. For realizing a negative torque command of the driver, the driver command torque is corrected with the loss torque weighted in dependence upon accelerator pedal position and rpm.

10 Claims, 3 Drawing Sheets

METHOD AND DEVICE FOR OPERATING THE DRIVE MOTOR OF A VEHICLE

FIELD OF THE INVENTION

This application is the national stage of PCT/DE 02/02441, filed Jul. 4, 2002, designating the United States.

The invention relates to a method and an arrangement for operating a drive motor of a vehicle.

BACKGROUND OF THE INVENTION

Electronic control systems are used in order to operate drive units for vehicles. With the aid of the electronic control systems, the parameter(s), which are adjustable at the drive unit, are fixed in dependence upon input quantities. Some of these electronic control systems operate on the basis of a torque structure, that is, torque values are inputted as desired values for the control system by the driver and, if required, by additional systems including: road speed controller, electronic stability programs, transmission controls, et cetera. These torque values are converted by the control system while considering additional quantities into adjusting variables for the power parameter(s) of the drive motor. An example of such a torque structure is known, for example, from DE 42 39 711 A1 (U.S. Pat. No. 5,558,178).

In such control systems, care must be taken that also a negative acceleration torque (engine braking) can be realized. In conventional control systems, this takes place by interrupting the fuel injection under specific conditions. For example, the interruption of the fuel supply is triggered in spark-ignition engines when the accelerator pedal is not depressed and the engine rpm lies above an rpm limit (see, for example, DE 44 45 462 A1). In controls for diesel engines, the fuel injection quantity is reduced to zero when the accelerator pedal is continuously released or withdrawn. In the course of unifying the control systems, there is therefore the need for a procedure for realizing a negative acceleration torque with the objective of vehicle deceleration. The same (identical) torque structure is used independently of the type of drive (for example, spark-ignition engine or diesel engine or electric motor).

SUMMARY OF THE INVENTION

In an advantageous manner, a torque structure for controlling a drive motor is pregiven by considering a loss torque weighted in dependence upon the accelerator pedal position and the rpm of the drive motor. This torque structure is independent of the type of drive. It is especially advantageous that this torque structure can be used in the same manner for spark-ignition engines and for diesel engines and also for electric motors.

Furthermore, the advantageous characteristic results that there is no consideration of the weighted loss torque in the formation of the driver input not only with a non-depressed accelerator pedal but also at low motor rpms. In this way, a deceleration desire of the driver (wheel torque level) is assumed only for a released accelerator pedal and higher rpms. For higher rpms, the pedal position inputs the extent of the deceleration desired. For a completely released pedal, a high deceleration is wanted and for a depressed pedal in the region of less than 15%, a reduced deceleration is wanted and for a pedal position greater than approximately 15%, acceleration is wanted.

The consideration of the weighted loss torque is limited to rpms above an engine rpm threshold so that an interruption of the fuel injection in spark-ignition and diesel engines only takes place when the accelerator pedal is not depressed and the engine rpm lies above a boundary rpm.

In this way, the consideration of loss torques for a depressed accelerator pedal and high rpm is made possible which is a condition precedent for a wheel torque constant shift operation.

It is further advantageous that the precontrol via the loss torque is maintained below the limit rpm so that the idle controller is relieved of load. The idle control need only control that component which constitutes the deviation of the actual loss torque from the precontrolled loss torque.

In an advantageous manner, the requirement is satisfied to relieve the idle controller of load and to reduce the influencing of the engine torque by the idle control.

It is especially advantageous that the torque structure for spark-injection engines and diesel engines can be designed uniformly, especially with respect to the torque coordination (formation of a resulting desired torque from different desired torques of driver, stability program, road speed controller, et cetera) and the precontrol (consideration of the loss torques for the conversion of the resulting desired torque into power parameters of the drive motor).

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
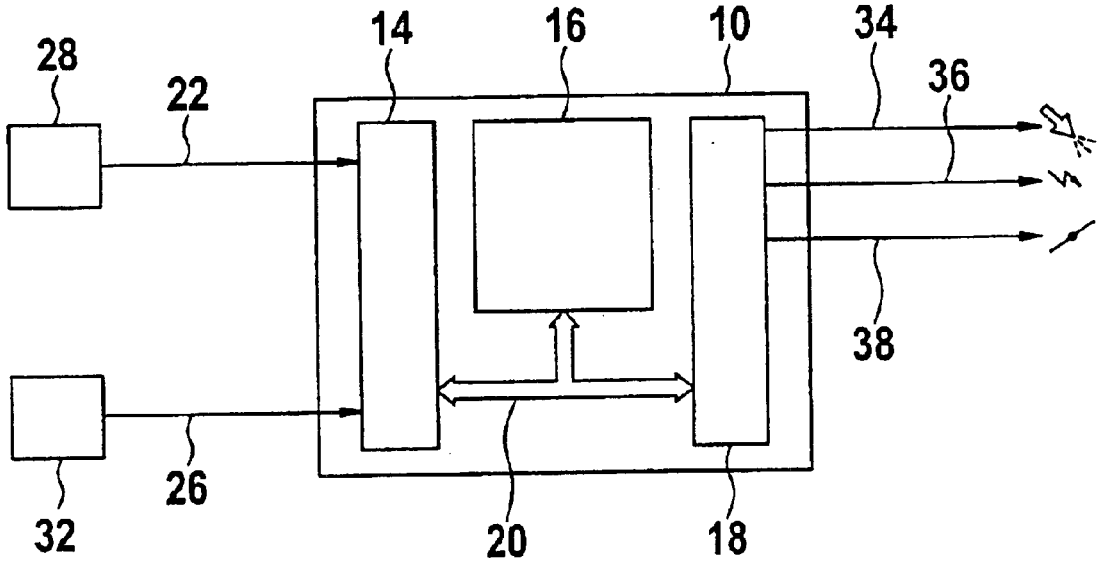
FIG. 1 shows an overview diagram of a control arrangement for operating a drive motor; whereas, in FIG. 2, with respect to a sequence diagram, a preferred embodiment of a torque structure is shown in combination with the control of a drive motor insofar as this control is of concern with a view to the described procedure.

FIG. 1 shows a block circuit diagram of a control circuit for controlling a drive motor, especially, of an internal combustion engine. A control unit 10 is provided which includes, as components, an input circuit 14, at least one computer unit 16 and an output circuit 18. A communication system 20 connects these components for the mutual exchange of data. Input lines 22 to 26 are connected to the input circuit 14 of the control unit 10. In a preferred embodiment, these input lines are configured as a bus system and signals are supplied thereover to the control unit 10. These signals represent operating variables to be evaluated for controlling the drive motor. These signals are detected by measuring devices 28 to 32. In the example of an internal combustion engine, operating variables of this kind are: accelerator pedal position, engine rpm, engine load, exhaust-gas composition, engine temperature, et cetera. The control unit 10 controls the power of the drive motor via the output circuit 18. This is symbolized in FIG. 1 with output lines 34, 36 and 38 via which the following are actuated: the fuel mass to be injected, the ignition angle and at least an electrically actuable throttle flap for adjusting the air supply. The following are adjusted via the shown actuating paths: the air supply to the internal combustion engine; the ignition angle of the individual cylinders; the fuel mass to be injected; the injection time point; and/or, the air/fuel ratio, et cetera. In addition to the described input quantities, additional control systems of the vehicle are provided which transmit input quantities, for example, torque desired values to the input circuit 14. Control systems of this kind are, for example, drive slip controls; driving dynamic controls; transmission controls; engine drag torque controls; speed controller; speed limiter; et cetera. In addition to these external desired value inputs, internal input quantities for the drive motor are provided, for example: the output signal of an idle control, the output signal of an rpm control, the output signal of torque limiting, et cetera. The following also belong to the external desired inputs: a desired value input by the driver in the form of a driver command or a maximum speed limitation.

If the driver moves the foot from the accelerator pedal, then the driver, as a rule, wants the vehicle to decelerate. The control of the drive motor of the vehicle has the responsibility to convert this command of the driver for vehicle deceleration correspondingly. A procedure which performs this and which makes available a uniform structure for spark-ignition engines and diesel engines and electric drives is shown with respect to the sequence diagram of FIG. 2. The essence of this torque structure is the consideration of the negative loss torque weighted in dependence upon accelerator pedal position and engine rpm for the driver command torque determined from the accelerator pedal characteristic field. The weighting is so undertaken that, at high rpms and released accelerator pedal, the weighting factor is 1; whereas, at low rpms or at large accelerator pedal angle, the weighting is 0. This means that, for a weighting factor of 1, the loss torque, which is superposed in the further course of the torque structure, is compensated. In this way, a control of the drive motor takes place which leads to a large vehicle deceleration; whereas, for a weighting factor of 0, no compensation of this loss torque takes place and therefore a control of the drive motor takes place which effects a lesser acceleration. In the preferred embodiment, a continuous dependency is present between weighting factor and pedal position or engine rpm so that the driver can input a deceleration command (wheel torque level) by actuating the pedal. This deceleration command is then realized by the different degree of loss torque compensation.

Figure 2:
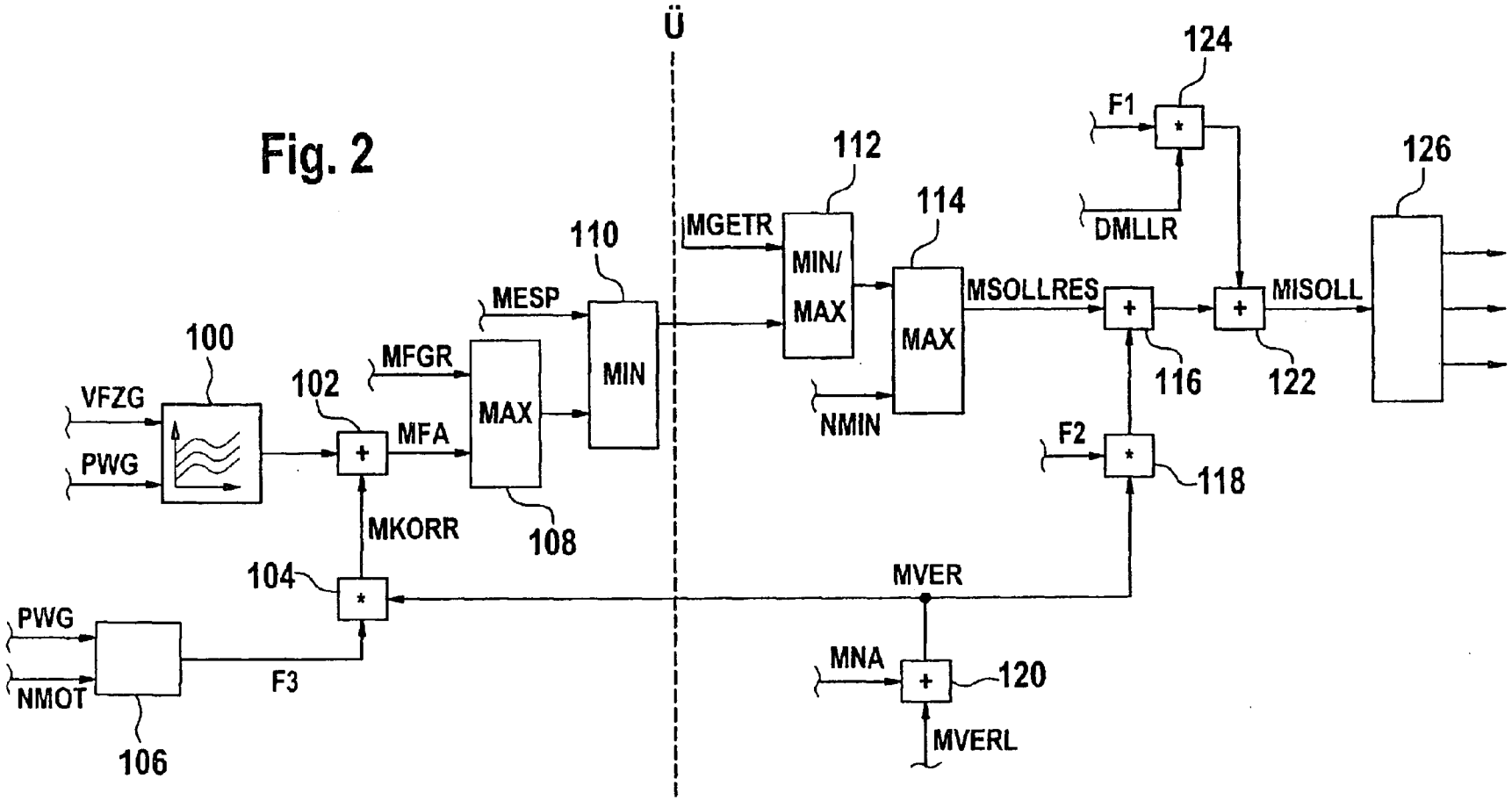

The sequence diagram shown in FIG. 2 describes a program of a microcomputer of the control unit 10. The individual blocks of the illustration of FIG. 2 represent programs, program parts or program steps while the connecting lines represent the signal flow. Here, the first part up to the perpendicular broken line can run in a separate control unit (there, likewise in a microcomputer) from the part after this line.

Figure 3:
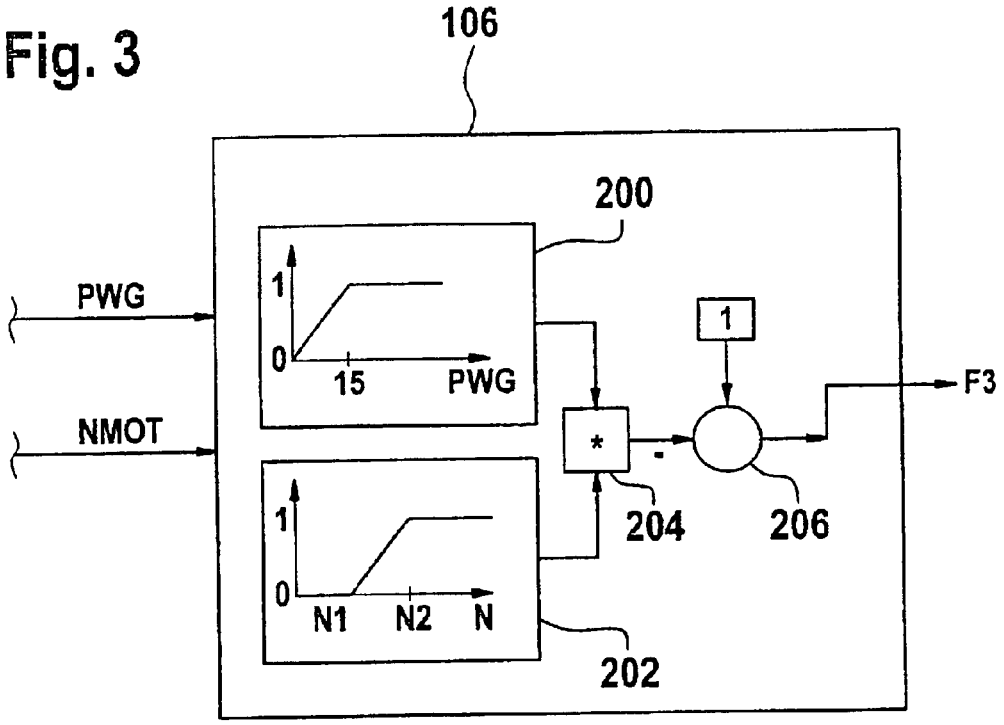
FIGS. 3 and 4 show two preferred embodiments for forming a corrective term with the aid of which the deceleration demand of the driver is formed on the wheel torque level.

First, signals are supplied which correspond to the vehicle speed VFZG as well as the accelerator pedal position PWG. These variables are converted into a torque command of the driver in a characteristic field 100. This driver command torque is supplied to a corrective stage 102 and defines an input quantity for a torque at the output end of the transmission, that is, for a wheel torque. This correction is preferably an addition or subtraction. The driver command torque is corrected by a weighted loss torque MKORR which was formed in the coupling position 104. In this coupling position 104, the supplied loss torque MVER is weighted with a factor F3. The loss torque MVER is converted by means of the transmission ratio U in the drive train as well as, if required, additional transmission ratios in the drive train, at the output end of the transmission, to a torque downstream of the transmission, preferably, to a wheel torque. The weighting takes place preferably as a multiplication. The factor F3 is formed in 106 from the quantity PWG, which represents the accelerator pedal position and a quantity NMOT, which represents the engine rpm. The factor F3 is formed in the manner described with respect to FIG. 3 or 4.

The driver command MFA, which is formed in this way, is supplied to the torque coordination for forming a resulting input torque MSOLLRES. In the example shown, the maximum value is selected in a first maximum value selection stage 108 from the driver command torque MFA and the input torque MFGR of a road speed controller. This maximum value is supplied to a downstream minimum value stage 110 wherein the lesser of this value and the desired torque value MESP of an electronic stability program is selected. The output quantity of the minimum value stage 110 defines a torque quantity at the output end of the transmission or a wheel torque quantity which is converted into a torque quantity which is present at the transmission input end or output end of the drive motor. This torque quantity is converted by considering the transmission ratio U as well as, if required, additional transmission ratios in the drive train at the output end of the transmission. This torque quantity is coordinated in a further coordinator 112 with the desired torque MGETR of a transmission control. The desired torque of the transmission control is formed in accordance with the requirements of the shift operation. In the next downstream maximum value selection stage 114, the resulting desired torque MSOLLRES is formed as the greater of the torque values minimum torque MMIN and the output torque of the coordinator stage 112.

This torque coordination above is only exemplary. In other embodiments, the one or the other input torque is not applied for coordination or additional input torques are provided, for example, a torque of a maximum speed limiting, of an engine rpm limiting, et cetera.

The resulting desired torque, which is formed in the manner described above, is supplied to a correction stage 116 wherein the desired torque is corrected with the loss torques, which are to be developed by the engine and are not available to the drive. The loss torques MVER are, if required, weighted by a factor F2 in a weighting stage 118. This factor F2 could be constant or be dependent upon an operating variable, for example, could be engine rpm dependent. The loss torques MVER are themselves formed in an addition stage 120 from the torque requirement MNA from ancillary equipment and the engine loss torque MVERL. The determination of these quantities is known from the state of the art. The torque requirement is determined in dependence upon the operating status of the particular ancillary equipment in accordance with characteristic lines or the like and the engine loss torque is determined in dependence upon engine rpm and engine temperature in accordance with characteristic lines. The loss torque MVER, which is formed in this way, is then made available to the correction stage 104. A conversion of the loss torque takes place with the aid of the known transmission ratio U as well as, if required, additional transmission ratios in the drive train at the output end of the transmission to the level of the transmission output torque or wheel torque.

The output quantity of the correction stage 116, which is defined as addition in the preferred embodiment, is an input quantity for the following: the torque, which is to be generated by the drive unit for the drive; for overcoming the internal losses; and, for operating ancillary equipment (for example, climate control compressor). This input torque is corrected (preferably added) in a further correction stage 122 by the output quantity DMLLR of the idle control which is weighted in a correction stage 124. The weighting factor Fl, with which the output quantity of the idle controller is weighted in 124, is dependent upon rpm and/or time. When leaving the idle range, the factor decreases to 0 as a function of time or with increasing engine rpm. The input quantity MISOLL is converted in 126 as known from the state of the art into actuating quantities for adjusting the power parameters of the drive unit. In the case of a spark-ignition engine, the air supply, fuel injection and ignition angle are adjusted and, in the case of a diesel engine, the fuel quantity, et cetera, are adjusted.

What is essential is that a correction of the driver command takes place by means of the deceleration command determined in 106 in such a manner that the loss torque, which is superposed in the further course on the torque control, is compensated. This compensation leads to the situation that the input value MISOLL has a value which leads to a braking action of the engine when the accelerator pedal is released and there is no external intervention. The input value MISOLL is converted into power parameters of the drive motor. In internal combustion engines, this value is 0 in the ideal case (compensation of the loss torque, idle controller intervention at high rpm not effective). Such a torque value is then realized by switching off the fuel injection.

The weighting of the loss torques to correct the driver command torque takes place in dependence upon the accelerator pedal position and engine rpm so that, for engine rpms which become less, no compensation or no complete compensation of the loss torque is undertaken. The inner losses of the drive motor as well as the requirement of ancillary equipment can be developed by the drive motor in the low rpm range when the accelerator pedal is released.

The factor F3, which also can be interpreted as a deceleration command of the driver, is formed in 106 in dependence upon the accelerator pedal position and the engine rpm. Various embodiments are conceivable which are shown with respect to FIGS. 3 and 4. What is essential is that the dependency of the deceleration command is so pregiven by the two above-mentioned quantities that, for high rpms and released accelerator pedal, an almost complete compensation takes place (F3=1); whereas, at low rpms or at large accelerator pedal angles, no compensation takes place (F33=0).

In a first embodiment (FIG. 3), two characteristic lines 200 and 202 are provided as components of 106. In the first characteristic line 200, a weighting factor, which moves between 0 and 1, is plotted as a function of accelerator pedal signal PWG. With an actuation of the accelerator pedal of >15%, this weighting factor is 1; whereas the weighting factor returns linearly to the value 0 below 15% with decreasing accelerator pedal position. In the second characteristic field 202, a further weighting factor, which likewise moves between 0 and 1, is shown in dependence upon engine rpm N. Up to an engine rpm N1, this factor is 0 and, above a greater engine rpm N2, this factor is 1. The weighting factor preferably increases linearly with increasing rpm between the engine rpms N1 and N2, which cover the range of idle rpm (for example, between 500 revolutions per minute and 1500). The two weighting factors are multiplied by each other in the multiplication position 204 and are subtracted from 1 in the subtraction position 206. The result is the corrective factor F3, which represents the deceleration command of the driver and with which the loss torque value is weighted. F3 is 1 when both factors of the characteristic lines are 0 and is 0 when both factors are 1.

Figure 4:
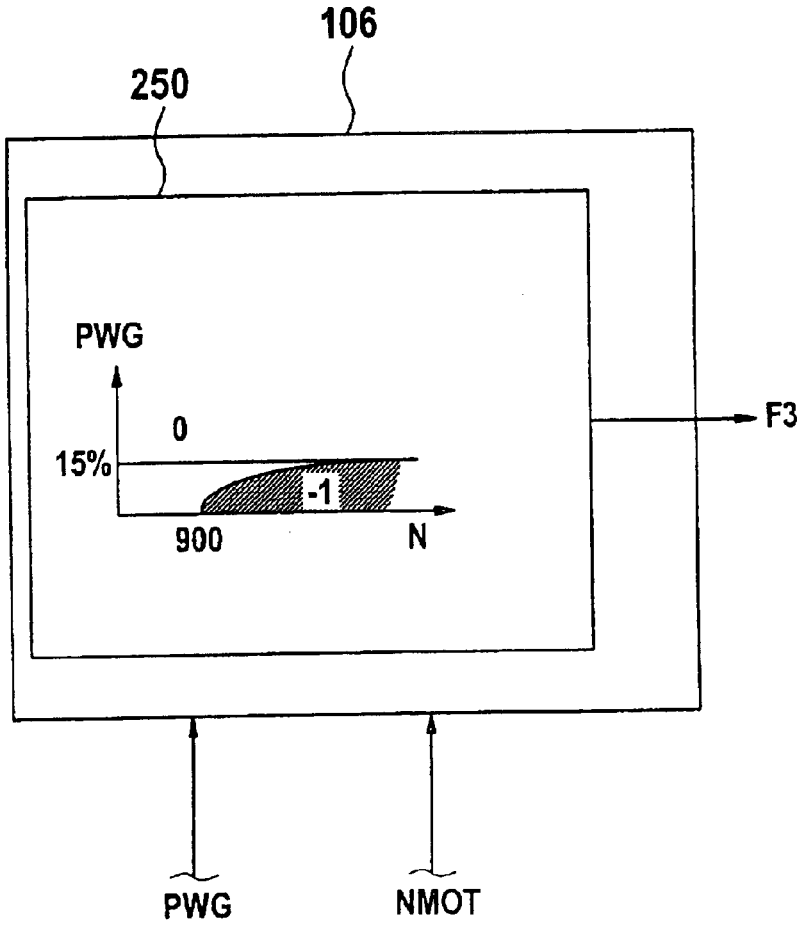

In a second embodiment shown in FIG. 4, a characteristic field 250 is provided wherein the weighting factor F3 is plotted as functions of accelerator pedal position PWG and engine rpm NMOT. The example in FIG. 4 shows a characteristic field trace wherein the weighting factor is 0 above a characteristic line starting at 900 rpm and an accelerator pedal angle of 0% and running with increasing engine rpm to an accelerator pedal position value of 15% and, the weighting factor is −1 below this characteristic line. Accordingly, if the accelerator pedal is released (accelerator pedal position <15%) and if the engine rpm is at values >900 rpm, then −1 is given as the corrective factor which leads to a complete compensation of the loss torque. For spark-ignition engines and diesel engines, the result of this compensation is a switchoff or interruption of the fuel injection thus making available the complete engine drag torque and the realization of the deceleration command wanted by the driver in a manner known per se. In a transition region, the weighting factor assumes values between 0 and −1. In this region, the loss torques are partially compensated so that a continuous transition between maximum deceleration and deceleration 0 arises.

In another embodiment, the correction of the driver command torque does not take place but the correction of another torque value, for example, the resulting desired torque or a torque value which arises in the context of the torque coordination.

Furthermore, in an alternative embodiment, the deceleration command of the driver is not, as shown above, inputted absolutely as a relative weighted loss torque. For this purpose, the deceleration command is pregiven in dependence upon accelerator pedal position and rpm, for example, by means of a characteristic field, and is superposed on the driver command torque as a corrective value. The deceleration command becomes greater with reducing pedal position and increasing rpm.

In a further embodiment, normalized quantities are used as input quantities in lieu of absolute values for the accelerator pedal position and/or for the rpm. These normalized quantities are accelerator pedal position, for example, normed to maximum position value, rpm, for example, normed to idle rpm. This is especially advantageous with the consideration of an operating state dependent rpm threshold for the loss torque compensation. The loss torques are superposed on the resulting desired torque when exceeding a (normalized) rpm threshold.

What is claimed is:

1. A method for operating a drive motor of a vehicle, the method comprising the steps of:

pregiving an input quantity for a torque of the drive motor in dependence upon a driver command;

determining a deceleration command of the driver in dependence upon the accelerator pedal position and the engine rpm; and, superposing the deceleration command on the driver command to form a corrected driver command as the input quantity for the control of the drive motor.

2. The method of claim 1, comprising the further steps of:

determining a loss torque representing the torque of the drive motor, which is necessary for overcoming the motor losses and/or for operating the ancillary accessories;

considering torque of the drive motor in dependence upon the input quantity when controlling the drive motor; and, weighting the loss torque in dependence upon accelerator pedal position and engine rpm and correcting the input quantity in dependence upon the weighted loss torque.

3. The method of claim 2, wherein the weighting of the loss torque value takes place in dependence upon the deceleration command of the driver.

4. The method of claim 3, wherein the deceleration command is formed in dependence upon accelerator pedal position and engine rpm; a large deceleration command is assumed when the rpm is high and the accelerator pedal is released; whereas a low deceleration command is assumed when the rpm is low or the accelerator pedal angle is large.

5. The method of claim 1, wherein the input quantity is the driver command torque which defines a transmission output torque or a wheel torque.

6. The method of claim 1, wherein the drive unit is a spark-ignition engine or a diesel engine.

7. An arrangement for operating a drive motor of a vehicle, comprising:

an electronic control unit which inputs an input quantity for a torque of the drive motor in dependence upon the driver command;

said control unit including means for determining a deceleration command of the driver in dependence upon accelerator pedal position and engine rpm; and, means for superposing the deceleration command of the driver on the driver command to form a corrected driver command as the input quantity for controlling the drive motor.

8. The arrangement of claim 7, said control unit further including: means for determining a loss torque which is not available for the drive; means for considering this loss torque in the control of the drive motor in dependence upon the input quantity; and, means for correcting the input quantity to form a corrected quantity as the loss torque weighted in dependence upon accelerator pedal position and engine rpm.

9. A computer program comprising a program code for carrying a method for operating a drive motor of a vehicle when the program is executed on a computer, the method including the steps of:

pregiving an input quantity for a torque of the drive motor in dependence upon a driver command;

determining a deceleration command of the driver in dependence upon the accelerator pedal position and the engine rpm; and, superposing the deceleration command on the driver command to form a corrected driver command as the input quantity for the control of the drive motor.

10. A computer program product comprising program code means stored on a computer readable data carrier in order to carry out the method for operating a drive motor of a vehicle, the method including the steps of:

pregiving an input quantity for a torque of the drive motor in dependence upon a driver command;

determining a deceleration command of the driver in dependence upon the accelerator pedal position and the engine rpm; and, superposing the deceleration command on the driver command to form a corrected driver command as the input quantity for the control of the drive motor.

* * * * *